United States Patent [19]

Maezawa et al.

[11] 4,183,203

[45] Jan. 15, 1980

[54] ELECTRONIC TIMEPIECE TIME ZONE DISPLAY

[75] Inventors: Shuji Maezawa; Yasushi Okada, both of Suwa, Japan

[73] Assignee: Kabushiki Kaisha Suwa Seikosha, Tokyo, Japan

[21] Appl. No.: 800,484

[22] Filed: May 25, 1977

[30] Foreign Application Priority Data

May 28, 1976 [JP] Japan ..... 51-61945

[51] Int. Cl.[2] ..... G04B 19/22; G04C 17/00

[52] U.S. Cl. ..... 58/42.5; 58/50 R

[58] Field of Search ..... 58/42.5, 43, 50 R

[56] References Cited

U.S. PATENT DOCUMENTS

| | | | |
|---|---|---|---|
| 2,662,368 | 12/1953 | Glenn | 58/43 |
| 2,794,314 | 6/1957 | Slaugh | 58/42.5 X |
| 2,910,825 | 11/1959 | Kirkwood | 58/43 |
| 3,633,354 | 1/1972 | Stemmler | 58/43 |
| 4,044,545 | 8/1977 | Shimizu | 58/42.5 |

*Primary Examiner*—S. J. Witkowski

*Attorney, Agent, or Firm*—Blum, Kaplan, Friedman, Silberman & Beran

[57] ABSTRACT

A digital display for an electronic timepiece having visual indication display segments peripherally disposed around a numerical display digit to selectively indicate a predetermined time zone corresponding to the time displayed by the numerical display digits is provided. The display is characterized by a bezel surrounding the plurality of visual indication display segments, the bezel having a plurality of first distinct indicia disposed therearound. Each of the first indicia are disposed proximate to the position of a visual indication display segment to identify the predetermined time zone selectively indicated by the visual identification display segment. A plurality of second indicia are disposed on the bezel, each second indicia being positioned between a specific visual indication display segment and a further first indicia representative of the time zone adjacent to the time zone represented by the specific visual indication display segment.

7 Claims, 3 Drawing Figures

ELECTRONIC TIMEPIECE TIME ZONE DISPLAY

BACKGROUND OF THE INVENTION

This invention is directed to a digital display for an electronic timepiece having a plurality of visual indication display segments peripherally disposed around numerical display digit for indicating a predetermined time zone corresponding to the time displayed by the numerical display digits, and in particular to a bezel surrounding the visual indication display segments and having additional indicia thereon for indicating a specific time zone corresponding to the time displayed by the numerical display digits when the time displayed by the numerical display digits is daylight savings time.

Heretofore, watches capable of providing an indication of the time for each of the twenty-four global time zones were, for the most part, mechanical or electromechanical hand display wristwatches. Such wristwatches were characterized by a bezel having a circular scale representative of each of the global time zones, with a location within each time zone being designated on the circular scale, in order to permit the wearer of the wristwatch to readily identify the particular time for that time zone. The bezel, including the circular scale indicating the respective time zones by the localities therein, is manually rotated with respect to the hand display and provides a less than completely satisfactory global timepiece. Moreover, it has been found that such rotatable scales are not particularly suited for use with digital displays since there are no hand display positions for orienting the rotatable scale.

However, a global digital display electronic timepiece has been developed wherein numerical digits are utilized to display time and a plurality of visual indication display segments, in the shape of an arrow and representative of each time zone, are utilized to visually indicate the particular time zone to which the numerical digits are indexed. Such a global timepiece is described in detail in U.S. patent application No. 768,461, filed on Feb. 14, 1977, and assigned to Kabushiki Kaisha Suwa Seikosha, the assignee herein, which application is incorporated by reference herein. It is noted however that since the bezel ring is not rotatable, with respect to the specific time zones indicated by the visual indication display segments, when summer occurs in a particular time zone, the wearer is unable to adjust the bezel to compensate for daylight savings time, which represents an hour difference. Accordingly, a digital display electronic timepiece having numerical display digits for selectively indicating a predetermined time zone, corresponding to the time digitally displayed and that permits daylight savings time to be read, is desired.

SUMMARY OF THE INVENTION

Generally speaking, in accordance with the instant invention, a digital display for an electronic timepiece having a plurality of visual indication display segments peripherally disposed about a numerical digital display for selectively indicating a predetermined time zone corresponding to the time displayed by the numerical display digits is provided. The timepiece is particularly characterized by a bezel surrounding the plurality of visual indication display segments. The bezel has a plurality of first distinct indicia disposed therearound, each of the indicia being disposed proximate to the position of a visual indication display segment for identifying the predetermined time zone selectively indicated by the visual identification display segment. A plurality of second indicia are disposed on the bezel, each of the second indicia being positioned between a specific visual indication display segment and further first indicia, representative of a time zone adjacent to the time zone represented by the specific visual indicia display segment.

In an exemplary embodiment, the plurality of visual indication display segments are utilized to visually indicate the twenty-four global time zones, and the second indicia are positioned between the visual indication display segments and a further indicia, representative of the time zone when daylight savings time is in effect.

Accordingly, it is an object of the instant invention to provide an improved digital display electronic timepiece.

Still a further object of the instant invention is to provide an improved digital display electronic timepiece for displaying global time information.

Still another object of the instant invention is to provide an improved digital display electronic timepiece having indicia for indicating the correct time zone when daylight savings time is in effect.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PRREFERRED EMBODIMENTS

Figure 1:
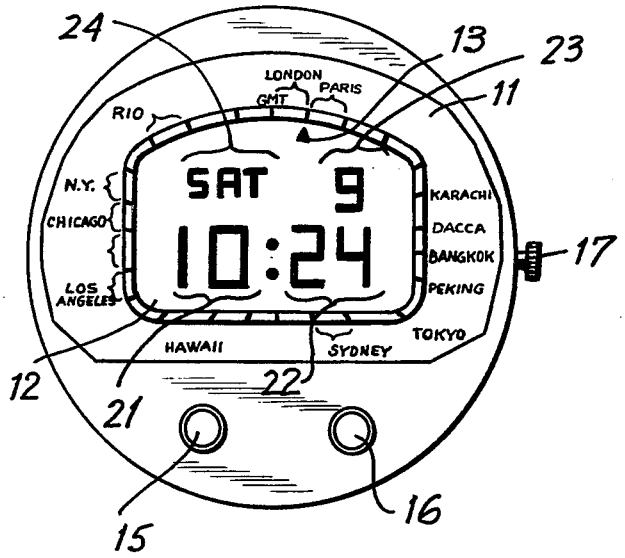
FIG. 1 is a plan view of a global electronic timepiece, and in particular a digital display therefor, constructed in accordance with the preferred embodiment of the instant invention.

Reference is first made to FIG. 1, wherein a liquid crystal digital display global electronic wristwatch, constructed in accordance with the instant invention, is depicted. For purposes of illustration, certain of the liquid crystal display segments, comprising the numerical digital display and a visual identification display segment, are illustrated in FIG. 1.

The global digital display is comprised of minutes digits 22, hours digits 21, date digits 23 and a day of the week display 24. With the exception of the tens of date digits and the tens of hours digits, the remaining numerical digits, for displaying minutes and hours, conform to a conventional seven-bar numerical display liquid crystal arrangement. Since the tens of date digit does not exceed three (3), and the tens of hours digit does not exceed one (1), a conventional seven-bar numerical configuration is not required. Additionally, the colon (:), between the minutes digits 22 and hours digits 21, can be formed from liquid crystal display segment electrodes or, alternatively, can be permanently formed on the face of the digital display. In order to effect a global display, twenty-four (24) visual indication display segments 13 are peripherally disposed around the numerical digital display, generally indicated as 12, each of the respective visual display segments being representative of one of the twenty-four global time zones. Printed on a bezel 11, adjacent to each of the further visual indication display segments, are indicia pointing out the particular locality or other designation identifying the particular time zone to which the visual indication display segments refer. As is explained in greater detail in U.S. patent application No. 768,461, which application is incorporated by reference as if fully set forth herein, the global display wristwatch energizes one of the time zone visual indication display segments 13 to illustrate the time zone corresponding to the time zone displayed by the numerical digits of the digital display. In order to obtain the time at a different time zone, the operator of the timepiece need only displace crown 17 to a time zone select position and, thereafter, actuate push button 15 or push button 16 on the face of the wristwatch. In response to actuating the push button 15, the time zones will be indexed in a clockwise direction, one time zone for each pushing of push button 15, whereas each pushing of push button 16 will result in an indexing by one of each of the time zones in a counter clockwise direction. Moreover, when the crown 17 is in other than a time zone selecting position, the push buttons 15 and 16 can be utilized as time correction switches.

As is diagramatically illustrated in FIG. 1, each of the global time zones are represented by indicia printed on the bezel, the indicia being indicative of either a specific geographical location in the time zone, or other information identifying the time zone. For example, the LONDON time zone is also represented by the designation GMT, which designation stands for Greenwich Mean Time. For the example illustrated in FIG. 1, the digital display 12 indicates that on the ninth day of the month in PARIS, which is a Saturday, the time is twenty-four minutes after ten.

Figure 2:
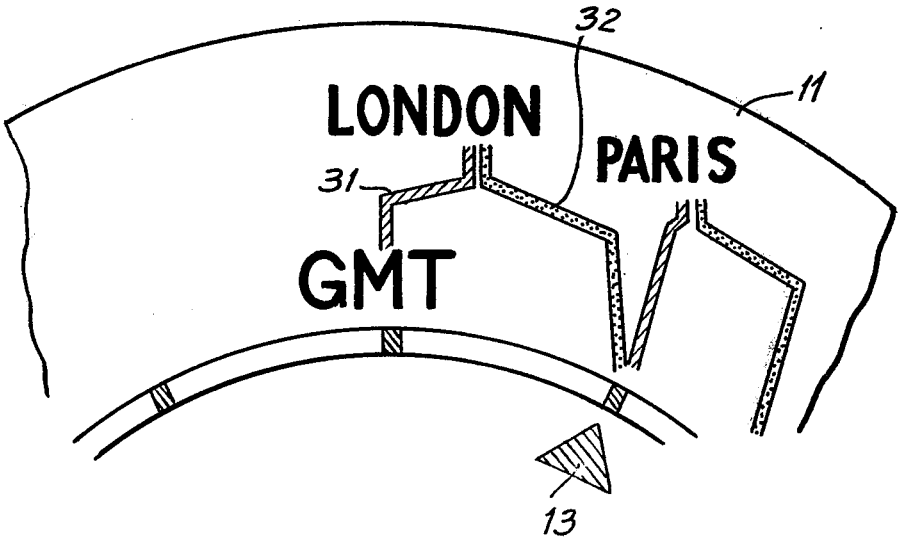
FIG. 2 is a part plan view of a global digital display constructed in accordance with a first embodiment of the instant invention.

Reference is specifically made to FIG. 2, wherein a portion of the bezel is depicted in an enlarged scale. A first indicia line 31 is disposed between the LONDON and GMT designation and the visual indication display segment corresponding thereto (not shown). A second indicia line 32 is disposed between the LONDON designation and the visual display segment 13 corresponding to the PARIS designation. Thus, the second indicia line 32 is disposed between the designation of Paris, which represents the time displayed in FIG. 1 during most of the year, and the designation LONDON, which represents the time displayed in FIG. 1 during the summer months when daylight savings time is in effect. Because the time zone change, that results during daylight savings time, is only one hour, by providing an additional indicia line between the visual indication display segments and a time zone designation representative of the time zone adjacent to the time zone normally represented by the visual indication display segment, the digital display facilitates the reading of time in a particular time zone in the summer months when daylight savings time is in effect, without requiring any adjustment of the numerical time display. In a preferred embodiment, the colors of the respective indicia lines 31 and 32 are different to thereby permit the wearer to readily distinguish between same.

Figure 3:
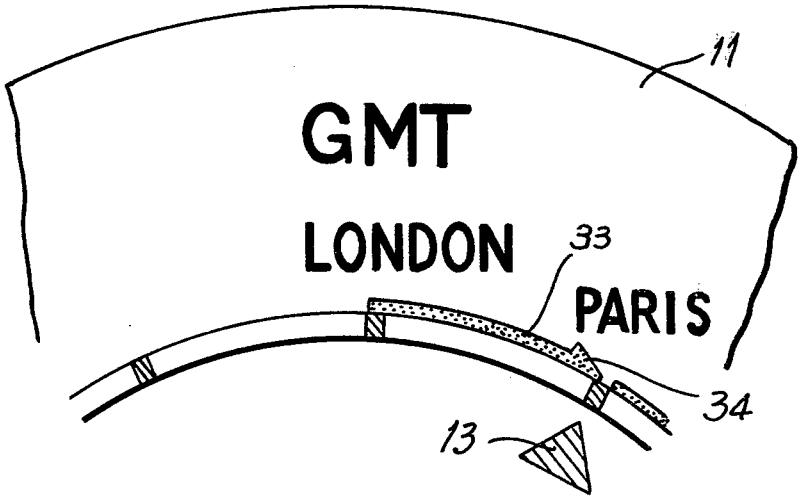
FIG. 3 is a part plan view of a global digital display constructed in accordance with a further embodiment of the instant invention.

Reference is now made to FIG. 3 wherein a global digital display, constructed in accordance with a further embodiment of the instant invention, is provided. A single indicia line 33 is disposed between the position that the specific visual indication display segment, corresponding to LONDON, is located and includes an arrow-like portion 34 pointing to the position at which the visual indication display segment, corresponding to PARIS, is located. By this designation, only a single indicia line need be provided in order to demonstrate to the wearer that during daylight savings time, the time indicated by the visual display segment refers to the time zone designation at the other end of the indicia line having the arrow pointing to the visual identification display segment. Although the use of an additional indicia line, for permitting daylight savings time to be readily identified, can be utilized with analog display mechanical and electro-mechanical timepieces, it is noted that this invention has less utility therein in view of the otherwise rotatable nature of the bezel ring in such mechanical type wristwatches.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a digital display for an electronic timepiece comprising in combination a plurality of numerical display digits for displaying time information and a plurality of visual indication display segments peripherally disposed about said numerical display digits for selectively indicating a predetermined time zone corresponding to the time displayed by said numerical display digits, the improvement comprising a bezel surrounding said plurality of visual indication display segments and having a plurality of first distinct indication means disposed therearound, each said first indication means being disposed proximate to the position of a visual indication display segment for identifying the predetermined time zone selectively indicated by the visual indication display segment, and a plurality of second indication means disposed on said bezel, each of said second indication means being positioned intermediate a specific visual indication display segment and a further first indication means representative of the time zone adjacent to the time zone represented by the specific visual indication display segment whereby the time zone indicated by the further first indication means corresponds to the time displayed by the numerical display digits when the time displayed is daylight savings time.

2. A digital display as claimed in claim 1, wherein said plurality of visual indication display segments includes twenty-four (24) display segments peripherally disposed around said numerical display digits, each of said display segments being representative of a specific global time zone.

3. A digital display as claimed in claim 2, wherein each of said second indication means are indicia lines having a first end proximate to a specific visual indication display segment representative of one of said predetermined twenty-four (24) global time zones and the other end proximate to a first indication means representative of a time zone adjacent to the specific time zone represented by the visual indication display segment to which the first end of the second indicia line is disposed proximate to.

4. A digital display as claimed in claim 3, wherein each of said indicia lines includes a substantially arrow shaped portion at the end proximate to said visual indication display segment.

5. A digital display as claimed in claim 2, wherein said first distinct indication means includes indicia representative of a time zone designation and a first indicia line having a first end thereof proximate to said time zone designation and the other end thereof proximate to said visual identification display segment corresponding to said time zone designation, and said second indication means includes a second indicia line having a first end proximate to a specific visual indication display segment and the other end proximate to a further time zone designation representative of the time zone adjacent to the time zone designated by the specific visual indication display segment.

6. A digital display as claimed in claim 5, wherein the first and second indicia lines are of a different color.

7. A digital display as claimed in claim 2, wherein each of said display digits and said visual indication display segments are liquid crystal display cells.

* * * * *